US007365629B2

(12) United States Patent
Furuya

(10) Patent No.: US 7,365,629 B2
(45) Date of Patent: Apr. 29, 2008

(54) SURFACE-MOUNT COIL PACKAGE AND METHOD OF PRODUCING THE SAME

(75) Inventor: Masahiro Furuya, Fujiyoshida (JP)

(73) Assignee: Citizen Electronics Co., Ltd., Yamanashi (JP)

( * ) Notice: Subject to any disclaimer, the term of this patent is extended or adjusted under 35 U.S.C. 154(b) by 0 days.

(21) Appl. No.: 11/580,432

(22) Filed: Oct. 13, 2006

(65) Prior Publication Data

US 2007/0030106 A1 Feb. 8, 2007

Related U.S. Application Data

(63) Continuation of application No. 11/165,685, filed on Jun. 24, 2005, now abandoned.

(30) Foreign Application Priority Data

Jun. 24, 2004 (JP) ..... 2004-186539

(51) Int. Cl.
*H01F 5/00* (2006.01)

(52) U.S. Cl. ..... 336/200

(58) Field of Classification Search ..... 336/65, 336/83, 192, 200, 232; 361/760–766
See application file for complete search history.

(56) References Cited

U.S. PATENT DOCUMENTS 5,307,041 A 4/1994 Kato et al.
5,726,612 A 3/1998 Mandai et al.
5,751,203 A 5/1998 Tsutsumi et al.
5,913,551 A 6/1999 Tsutsumi et al.
6,208,232 B1 3/2001 Chen
6,285,272 B1 9/2001 Boytor et al.
6,788,181 B2 9/2004 Yeh et al.
2002/0057029 A1 5/2002 Kataja
2004/0026123 A1 2/2004 Park

FOREIGN PATENT DOCUMENTS

JP 08/106840 4/1996
JP H10-189338 A 7/1998
JP 11150035 A * 6/1999

* cited by examiner

*Primary Examiner*—Tuyen T. Nguyen
(74) *Attorney, Agent, or Firm*—Brinks Hofer Gilson & Lione

(57) ABSTRACT

A substrate is prepared that includes substrate segments arranged in series in the X and Y directions. The substrate segments are respectively provided with circuit patterns on its one side and electrodes on the other side. Sets of IC devices including bobbins are mounted on the sides with the circuit patterns of the respective substrates. A conductor is wound around the bobbins successively to form the windings. Portions of the conductor extending between the adjacent windings are pressed against and connected to the circuit patterns to form leading and trailing ends of the windings connected to the circuit patterns. Thereafter, the substrate is severed to provide surface-mount coil packages each comprising the circuit board and the set of IC devices including the coil.

4 Claims, 8 Drawing Sheets

SURFACE-MOUNT COIL PACKAGE AND METHOD OF PRODUCING THE SAME

This application is a continuation of application Ser. No. 11/165,685 filed Jun. 24, 2005, now abandoned which claims priority under 35 U.S.C. §119 to Japanese Patent Application No. 2004-186539 filed Jun. 24, 2004. The entire contents of all of these applications are hereby incorporated by reference.

BACKGROUND OF THE INVENTION

1. Field of the Invention

The present invention relates to a surface-mount coil package for use, for example, in an EL (electroluminescence) drive circuit, an LED (light-emitting diode) drive circuit, or a DC power circuit, and also relates to a method of producing the same.

2. Description of the Related Arts:

A drive circuit for turning on an EL or an LED, or a DC power circuit uses a small-sized coil formed by winding a conductor around a bobbin made of a magnetic material, e.g. ferrite (see Japanese Patent Application Publication No. 2003-77738). In a thin compact electronic device, such a circuit used therein generally adapts a surface-mount coil package that includes a small-sized coil and its associated IC devices mounted on a circuit board (see Japanese Patent Application Publication No. 2004-336950).

FIG. 11 is a sectional view of a conventional small-sized coil 81. The coil 81 includes a bobbin 82 made of a magnetic material, and a winding 88 wound around the bobbin 82. A pair of terminal electrode plates 86 and 87 is secured to the bottom of the bobbin 82. End portions 88*a* and 88*b* of the winding 88 are wound around and soldered to the terminal electrode plates 86 and 87, respectively. When the coil 81 is mounted on a circuit board, the terminal electrode plates 86 and 87 are soldered to a wiring pattern on the circuit board.

FIG. 12 illustrates a part of an apparatus, whereby the bobbin 82 is gripped and rotated so that a conductor is wound around the bobbin to form the winding 88. Specifically, the apparatus has a spindle 61 and a chuck 91 secured to the spindle, the chuck having a pair of jaws 91*a* for gripping the bobbin 82 therebetween.

The gripped bobbin 82 has the electrode plates 86 and 87. The leading end of the conductor is wound around one of the electrode plates 86 to form a starting end 88*a* of the winding 88 of the coil 81. The spindle 61 is then rotated to rotate the bobbin 82, thereby winding the conductor around the bobbin 82 to form the winding 88. After the winding 88 is formed, a terminating end 88*b* of the winding 88 is wound around the other electrode plate 87. The conductor is then severed from the winding 88. The bobbin 82 with the winding 88 is removed from the chuck 91, and the starting and terminating ends 88*a* and 88*b* of the winding 88 are soldered or welded to the electrode plates 86 and 87, respectively. This completes forming of the coil 81.

To form the surface-mount coil package, the coil 81 and its associated IC devices (not shown) are mounted on a surface of a circuit board, the surface being formed with a wiring pattern. The coil 81 and the IC devices on the circuit board are then encapsulated with resin. Japanese Patent Application Publication No. 2004-336950 discloses a method of producing such a surface-mount coil package. According to this method, a substrate is formed with a multiplicity of wiring patterns. The wiring patterns are arranged in series in the X and Y directions. Sets of IC devices including a coil are mounted on and electrically connected to the respective wiring patterns. The resulting assemblies are encapsulated with resin. Thereafter, the substrate is cut to provide individual surface-mount coil packages each including a circuit board with the circuit pattern and the coil and the IC devices on the circuit board.

The method is suitable for use in mass production of coil packages. However, it needs a large number of coil winding machines, resulting in an increase in the cost of equipment. Further, it requires mounting/dismounting operation of coils in connection with the winding machines and, thus, increases the production time and cost of coils.

SUMMARY OF THE INVENTION

Accordingly, the present invention aims at minimizing the cost of equipment for production of coil packages and improving productivity thereof.

The present invention provides a method of producing a surface-mount coil package including a circuit board and a coil mounted on the circuit board. The circuit board has a wiring pattern on one surface thereof and terminal electrodes on the other surface thereof. The terminal electrodes are electrically connected to the wiring pattern. The coil includes a bobbin mounted on the circuit board and a winding wound around the bobbin. The method comprises: the steps of providing a flat substrate having a plurality of substrate segments; mounting a plurality of bobbins on the plurality of respective substrate segments; forming at least one group of the bobbins; successively winding a conductor on the bobbins of each group, thereby forming a winding on each of the bobbins; and separating the plurality of substrate segments from one another to provide independent coil packages. The substrate segments may be arranged in series in X and Y directions.

This method does not require a large number of coil winding machines to thereby enable space savings and reduction in the cost of equipment. Moreover, the method can cope with a variety of production processes, from small-lot, wide variety production to mass-production. In addition, the simplified coil production process allows cost reduction. Further, when the bobbins are divided into two or more groups and coil winding operations are performed in parallel with regard to the groups, the production efficiency can be performed.

The production method may further comprise pressing a portion of the conductor extending between adjacent windings against the wiring patterns; and, connecting the portion of the conductor to the wiring patterns, so that each of the windings has leading and trailing ends connected to the wiring pattern.

More specifically, the conductor may be connected to the wiring pattern by at least one selected from the group consisting of soldering, thermocompression bonding, and ultrasonic welding.

Other electronic components may be additionally mounted on the respective substrate segments and electrically connected to the respective circuit patterns.

The step of separating the substrate segments may be carried out by either cutting or breaking of the substrate, the breaking being effected along V-shaped grooves cut formed in the substrate.

The step of mounting bobbins on the substrate segments may be carried out by one selected from the group consisting of bonding the bobbins to surfaces of the substrate segments, fitting the bobbins into recesses formed in surfaces of the substrate segments, and fitting the bobbins into openings formed through the substrate segments.

In addition, the present invention provides a surface-mount coil package comprising a circuit board and a coil on the circuit board. The circuit board has opposite sides, a wiring pattern on one of the opposite sides, and electrodes on the other side. The electrodes are electrically connected to the wiring pattern. The coil has a bobbin secured to the circuit board, and a winding formed on the bobbin by winding a conductor therearound. The winding has a leading end directly connected to the wiring pattern, and a trailing end directly connected to the wiring pattern.

Specifically, the bobbins may be secured to the respective substrate segments by bonding the bobbins to surfaces of the respective substrates, or fitting the bobbins into recesses formed in the surfaces of the respective substrate, or fitting the bobbins into openings formed through the respective substrates.

The above and other objects, features and advantages of the present invention will become more apparent from the following description of the preferred embodiments thereof, taken in conjunction with the accompanying drawings.

DESCRIPTION OF THE PREFERRED EMBODIMENTS

Figure 1:
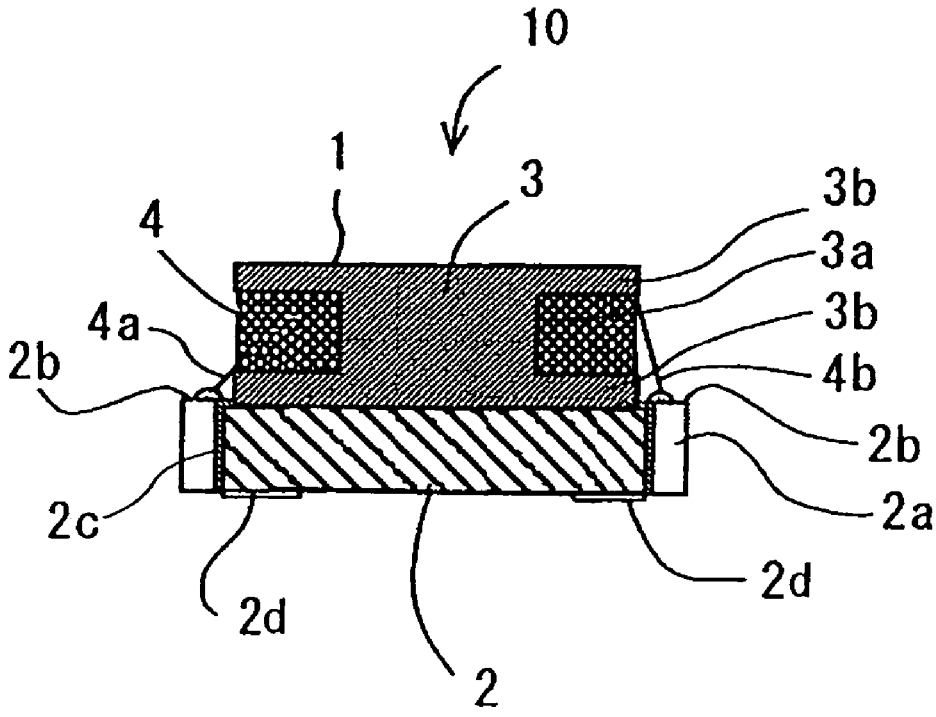
FIG. 1 is a sectional side view of a surface-mount coil package according to a first embodiment of the present invention.

FIG. 1 illustrates a surface-mount coil package 10 according to an embodiment of the present invention.

The surface-mount coil package 10 includes a circuit board 2 and a coil 1. The coil 1 has a bobbin 3 mounted on the circuit board 2, and a winding 4 formed by winding a conductor around the bobbin 3. The bobbin 3 has a columnar core 3*a* with the winding 4 provided therearound and a pair of disk-shaped flanges (upper and lower flanges) 3*b* on both ends of the core 3*a*. The circuit board 2 has a wiring pattern 2*b* formed on the upper surface (as viewed in FIG. 1) thereof and electrodes 2*d* provided on the lower surface thereof. The electrodes 2*d* are electrically connected to the wiring pattern 2*b* by respective pattern connecting portions 2*c* extending between the upper and lower surfaces. The bobbin 3 is secured to the upper surface of the circuit board 2. The leading and trailing ends of the conductor of the winding 4, i.e. a winding starting end 4*a* and a winding terminating end 4*b*, are connected to the wiring pattern 2*b* respectively by soldering, thermocompression bonding, ultrasonic welding, etc.

Figure 2:
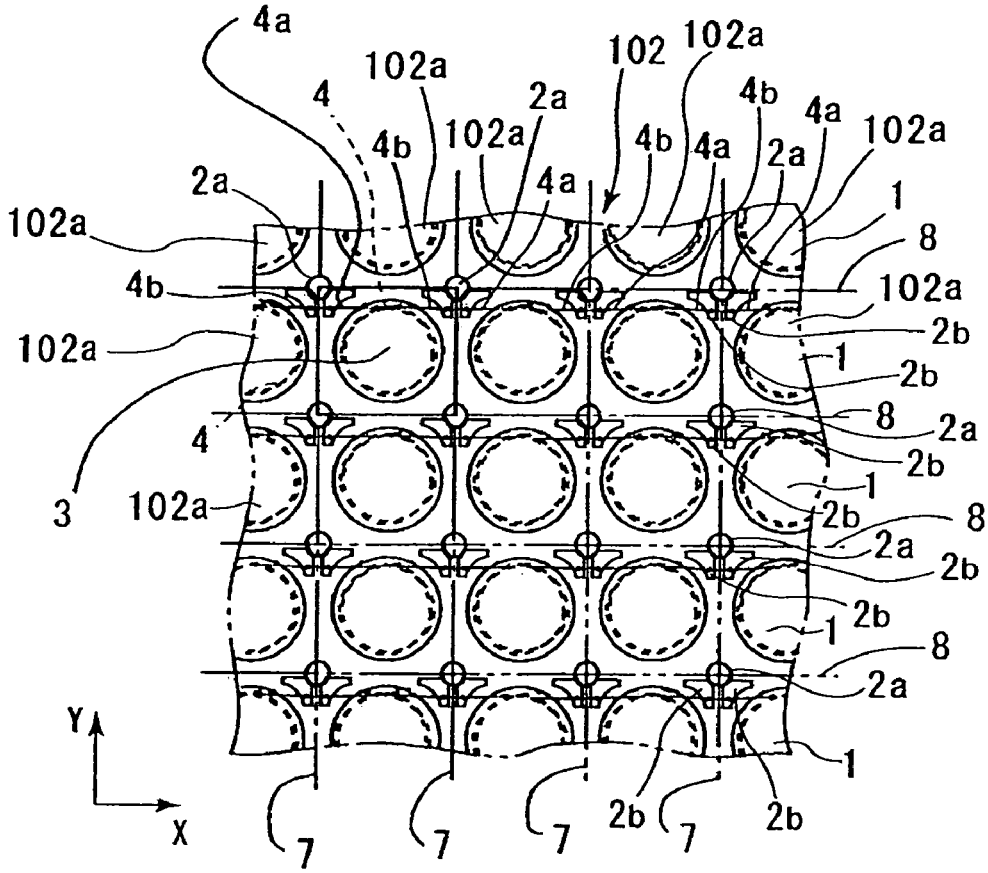
FIG. 2 is a plan view showing a part of coil packages formed on a single substrate according to the present invention, the substrate being divided to obtain the individual coil packages shown in FIG. 1.

Briefly, the surface-mount coil package 10 is produced as follows. A plate-like substrate 102 as shown in FIG. 2 is prepared that has a multiplicity of wiring patterns 2*b* formed on the obverse surface thereof in series in the X and Y directions (see FIG. 2). The substrate 102 also has on its reverse surface terminal electrodes 2*d* and the pattern connecting portions 2*c* formed on the wall surfaces of through holes 2*a* extending between the obverse and reverse surfaces thereof at the intersections between divisional lines 7 and 8. The divisional lines divide the substrate 102 into a plurality of square substrate segments 102*a* on which the wiring patterns 2*b* are respectively formed. The bobbins 3 are mounted on the respective substrate segments 102*a*. After windings 4 are formed on the bobbins 3, the winding starting ends 4*a* and the winding terminating ends 4*b* are connected to the respective wiring pattern 2*b*. Thereafter, the substrate 102 is cut along division lines 7 and 8 so as to produce the separated individual coil packages 10.

Figure 3:
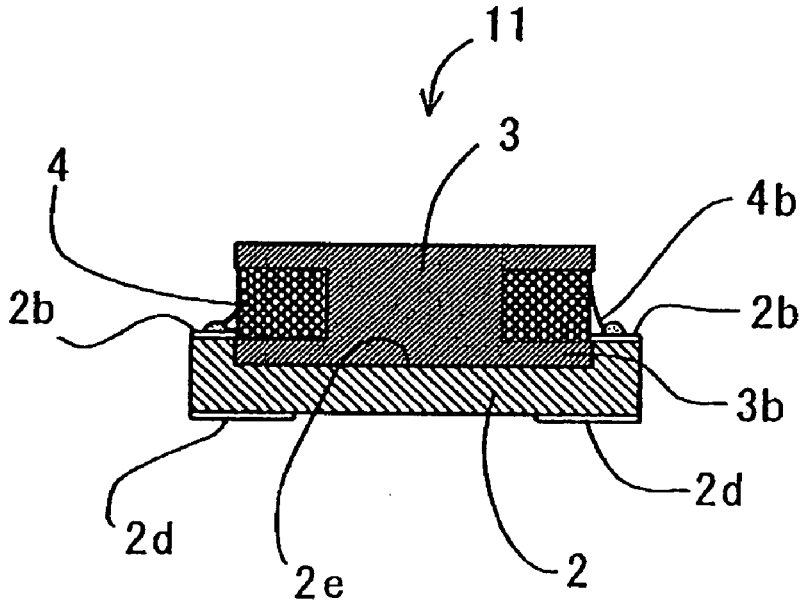
FIG. 3 is a sectional view of a surface-mount coil package according to a second embodiment of the present invention.

FIG. 3 shows a modification 11 of the surface-mount coil package shown in FIG. 1. The surface-mount coil package 11 has a similar arrangement to that of the coil package 10 shown in FIG. 1 and, therefore, like elements are denoted by like reference numerals and description thereof is omitted. In the surface-mount coil package 11, a recess 2*e* is formed in the obverse or upper surface of the circuit board 2. The lower flange 3*b* of the bobbin 3 is press-fitted into the recess 2*e*. Preferably, the lower flange 3*b* and the recess 2*e* are secured to each other with a double-sided pressure-sensitive adhesive tape or an adhesive.

Figure 4:
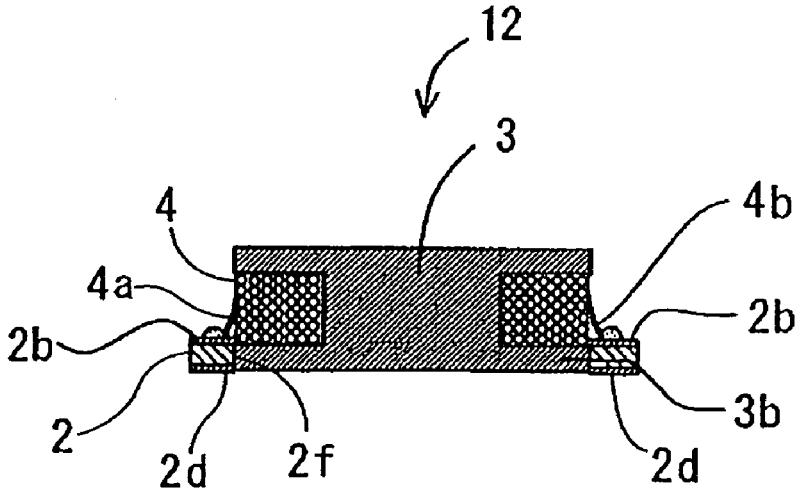
FIG. 4 is a sectional view of a surface-mount coil package according to a third embodiment of the present invention.

FIG. 4 is another modification 12 of the surface-mount coil package shown in FIG. 1. The circuit board 2 has approximately the same thickness as that of the lower flange 3*b* of the bobbin 3. The circuit board 2 has an opening 2*f* extending therethrough between the upper and lower surfaces thereof. The lower flange 3*b* of the bobbin 3 is press-fitted into the opening 2*f* and secured thereto with an adhesive or the like.

Figure 5:
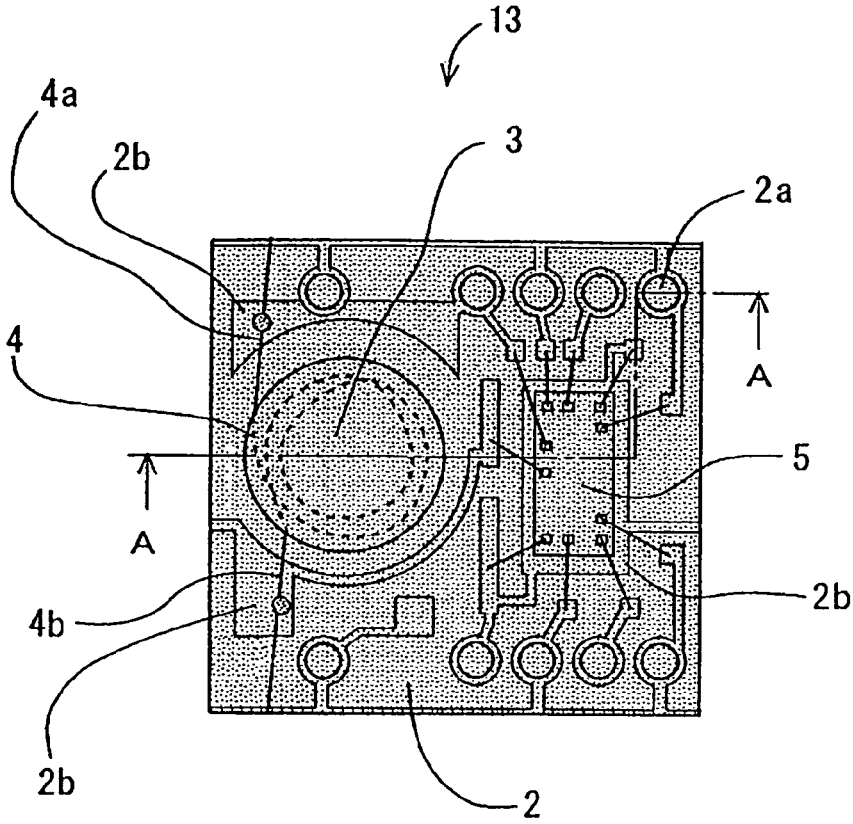
FIG. 5 is a plan view of a surface-mount coil package according to a fourth embodiment of the present invention.
Figure 6:
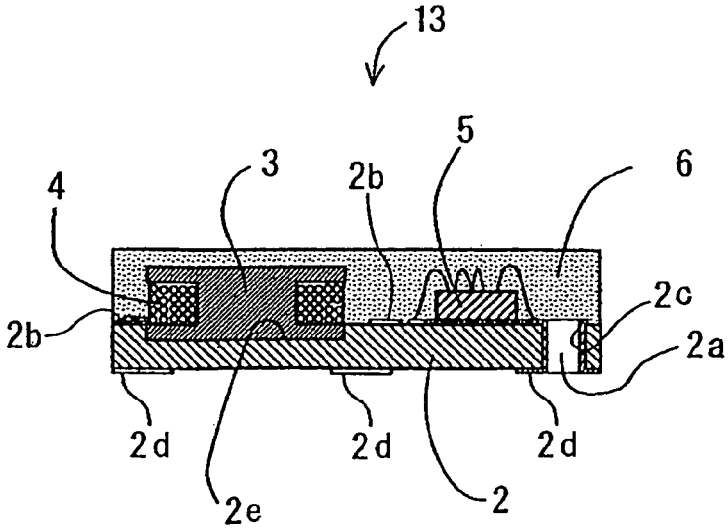
FIG. 6 is a sectional view taken along the line A-A in FIG. 5.
Figure 7:
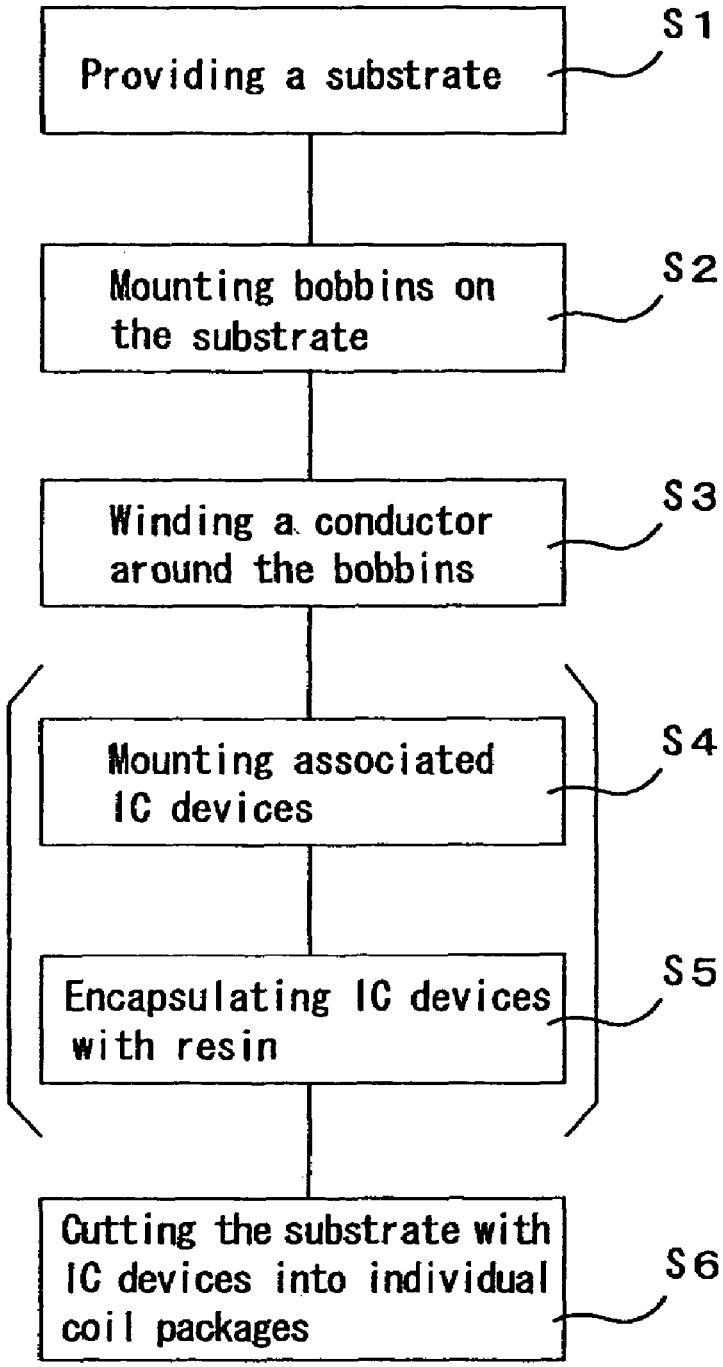
FIG. 7 is a flowchart showing the process of a method of producing a surface-mount coil package according to the present invention.

FIGS. 5 and 6 show a further modification 13 of the surface-mount coil package shown in FIG. 3. The surface-mount coil package 13 has an IC device or LED drive circuit 5 additionally provided on the obverse or upper surface of the circuit board 2. A wiring pattern 2*b* is electrically wired to the drive circuit 5 and connected to terminal electrodes 2*d* on the reverse lower surface of the circuit board 2 through pattern connecting portions 2*c* formed on the respective wall surfaces of through-holes 2*a*. Resin 6 is provided over these elements on the circuit board 2 to encapsulate them.

Next, a method of producing the above-described surface-mount coil packages according to the present invention will be described with reference to FIGS. 7-10.

In a step S1, a substrate 102 is provided, the lower surface (as viewed in FIG. 8) of the substrate 102 having wiring patterns 2*b* arranged in series in the X and Y directions.

Figure 8:
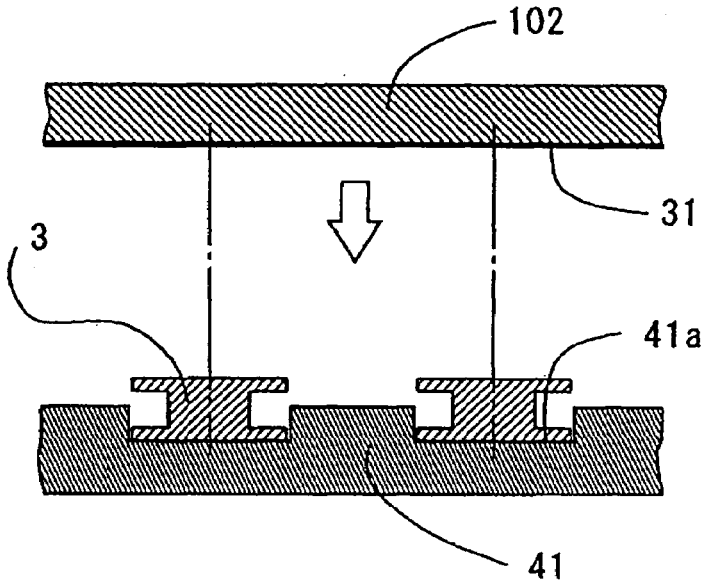
FIG. 8 is a view showing a bobbin mounting step carried out in the process of FIG. 7.

Next, in a step S2, a tray 41 as shown in FIG. 8 is prepared that has bobbin positioning recesses 41*a* whereby bobbins 3 are correspondingly positioned relative to the respective wiring pattern 2*b* formed on the substrate 102. A double-sided pressure-sensitive adhesive sheet 31 is stuck to the surface of the substrate 102 on which the wiring patterns 2*b* have been formed. The substrate 102 is placed on and pressed against the bobbins 3 held by the tray 41 so that the bobbins are attached to the substrate 102 through the adhesive sheet 31. In the case of large-diameter coil windings 4, an adhesive may be used in stead of the adhesive sheet to firmly bond the bobbins 3 to the substrate 102. When the coil packages 11 or 13 as shown in FIG. 3 or 6 are to be formed, the substrate 102 is provided with the bobbin-fitting recess 2*e* into which flanges of the bobbins are inter-fitted.

It should be noted that the process of mounting bobbins 3 onto the substrate 102 may be effected by using an X-Y positioning system capable of positioning each of the bobbins 3 instead of the tray 41.

Next, the production process proceeds to a coil winding step S3.

Figure 9:
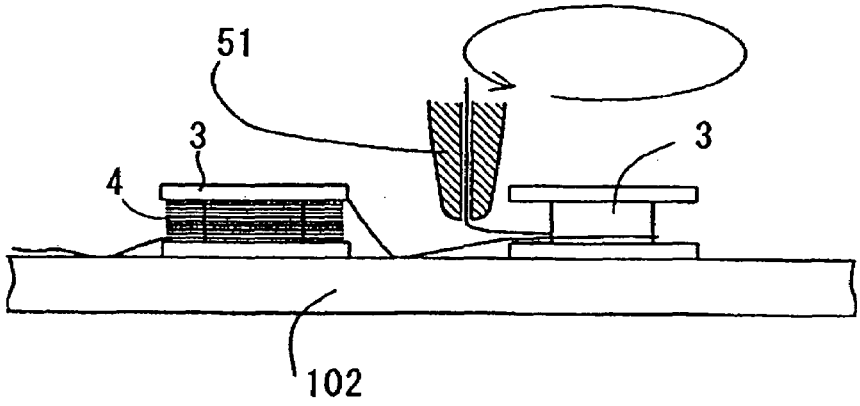
FIG. 9 is a view showing a coil winding step carried out in the process of FIG. 7.
Figure 10:
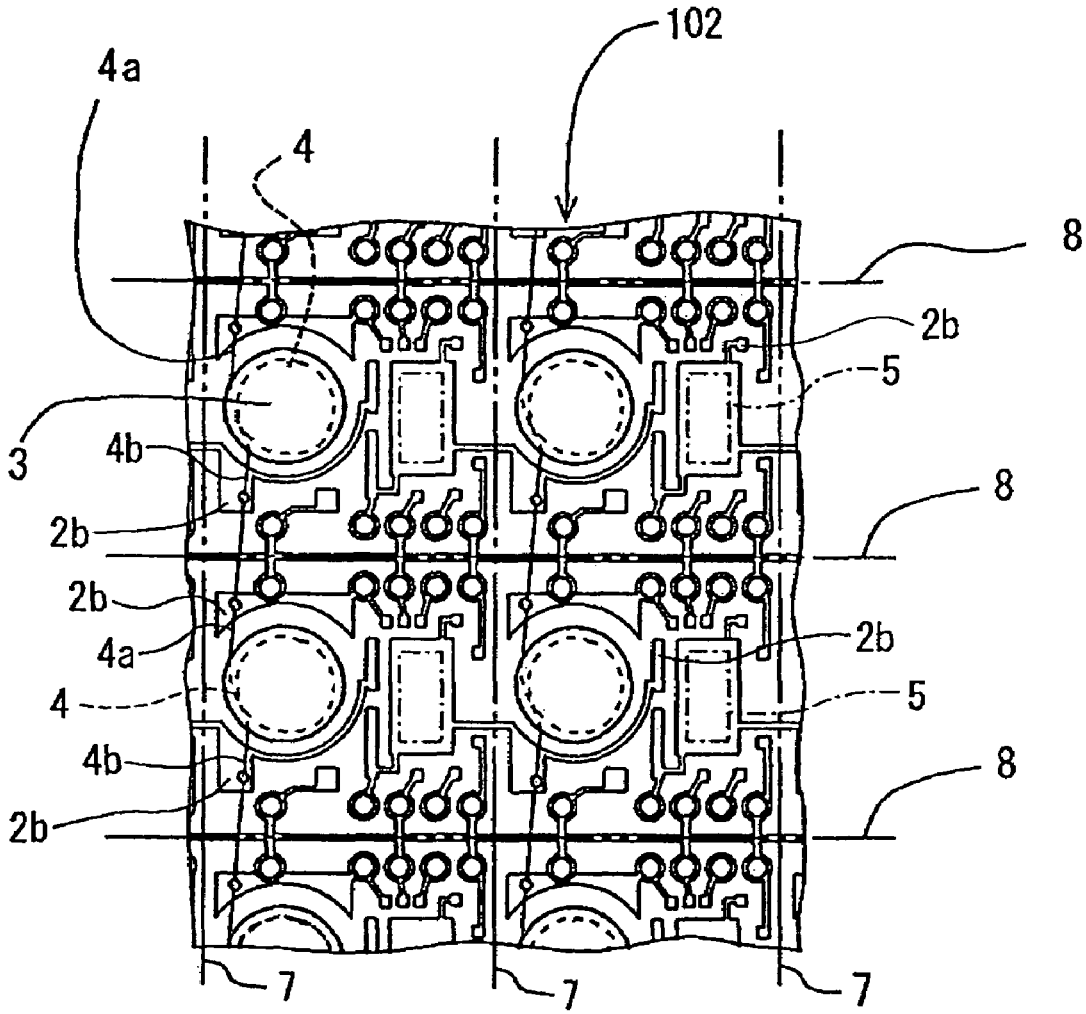
FIG. 10 is a plan view showing a part of coil packages formed on a single substrate according to the present invention, the substrate being divided to obtain the individual coil packages shown in FIGS. 5 and 6.
Figure 11:
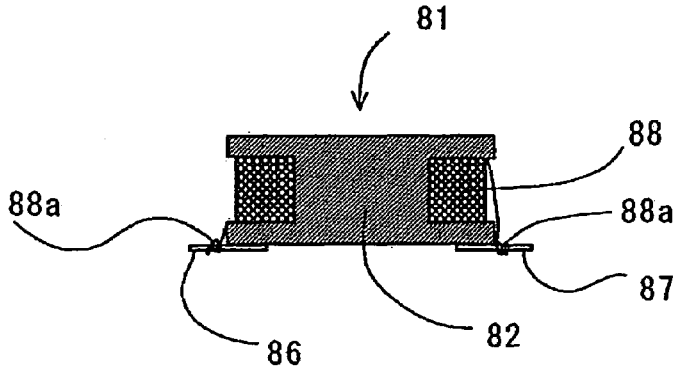
FIG. 11 is a sectional view of a conventional coil package.
Figure 12:
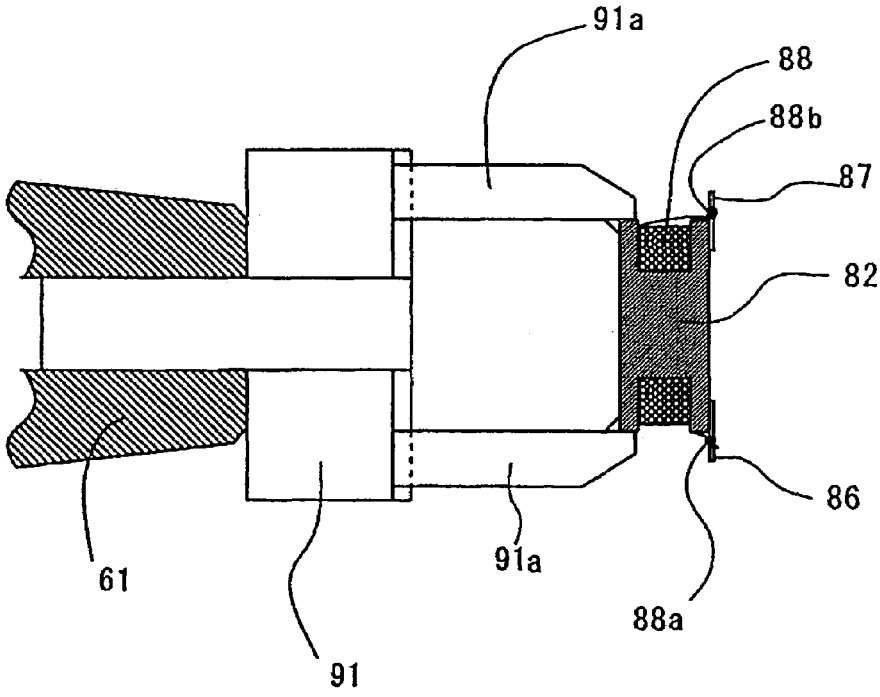
FIG. 12 is a sectional view showing a conventional coil winding method.

In FIG. 9, a nozzle 51 of a coil winding machine or robot (not shown) is used to supply a conductor. The nozzle 51 is turned around each of the bobbins as shown by the arrow in the figure. The nozzle 51 of the coil winding machine is controlled so as to form windings 4 on the respective bobbins 3 successively without cutting the conductor during the successive winding processes. At the stage where the windings 4 have been formed, the conductor, as shown in FIGS. 2 and 10, includes straight portions extending between adjacent windings 4. The straight extending portions of the conductor are then pressed against the wiring patterns and bonded thereto so that each winding 4 has starting and terminating ends 4*a* and 4*b* bonded to the associated wiring pattern 2*b*. The bonding process may be carried out, for example, by soldering, thermocompression bonding, a combination of soldering and thermocompression bonding, or ultrasonic welding.

When the coil package 13 as shown in FIGS. 5 and 6 is to be formed, the IC devices 5 are additionally mounted on the substrate 102 by die bonding, and the IC devices 5 and the associated wiring patterns are electrically connected by wire bonding. Thereafter, the production process proceeds to a resin encapsulating step S5 where the coils and the IC devices mounted on the substrate 102 are encapsulated with resin 6.

In a subsequent unitizing step S6, the substrate 102 is cut along the division lines 7 and 8 by dicing to obtain individual coil packages 1, 11, 12 or 13. Instead, the substrate 102 may be divided by a method wherein V-shaped grooves are formed on the substrate 102 along the division lines 7 and 8 at the step S1. No resin is coated on the division lines 7 and 8 at the resin encapsulating step S5. The substrate 102 is severed along the V-shaped grooves.

Although some embodiments of the present invention have been described above, it should be noted that the present invention is not necessarily limited to the foregoing embodiments. For example, the step of forming windings on bobbins may be carried out as follows. The bobbins on the substrate are divided into two or more groups, and a single conductor is prepared for each bobbin group. The conductor is wound around the bobbins of the associated group successively.

What is claimed is:

1. Surface-mount coil packages comprising:

at least two circuit board units connected in a plane which are separable after mounting of electrical components thereon;

at least one group of wiring patterns fabricated on each of the at least two circuit board units and;

a plurality of coils mounted on at least some of the at least two circuit board units, the plurality of coils comprising a single line of conductive wire which is wound around the plurality of coils and extends straight between the neighboring coils wherein the single line of conductive wire is bonded, en route between at least two neighboring coils, to the at least one group of wiring patterns of respective circuit board units on which the at least two neighboring coils are mounted.

2. Surface-mount coil packages of claim 1, wherein the at least some of the at least two circuit board units each have a recess formed therein, and the plurality of coils are mounted in the recesses, respectively.

3. Surface-mount coil packages of claim 1, wherein the at least some of the at least two circuit board units each have an opening formed therein, and the plurality of coils are mounted in the openings, respectively.

4. Surface-mount coil packages of claim 1, wherein the plurality of coils are secured to an upper surface of the at least some of the at least two circuit board units.

* * * * *